United States Patent [19]

Hood

[11] 4,248,281

[45] Feb. 3, 1981

[54] ROLL-REEFING JIB SAIL

[75] Inventor: Frederick E. Hood, Marblehead, Mass.

[73] Assignee: Hood Enterprises, Inc., Marblehead, Mass.

[21] Appl. No.: 49,422

[22] Filed: Jun. 18, 1979

[51] Int. Cl.[3] ..... B63H 9/08

[52] U.S. Cl. ..... 114/106

[58] Field of Search ..... 114/102, 104–107

[56] References Cited

U.S. PATENT DOCUMENTS

| | | | |
|---|---|---|---|
| 3,611,969 | 10/1971 | Hood | 114/106 |
| 3,800,729 | 4/1974 | Keeler | 114/106 |
| 3,851,609 | 12/1974 | Stearn | 114/105 |
| 3,938,460 | 2/1976 | Wales et al. | 114/106 |
| 3,948,200 | 4/1976 | Hood et al. | 114/105 |
| 4,030,439 | 6/1977 | Hood et al. | 114/106 |

*Primary Examiner*—Sherman D. Basinger

*Attorney, Agent, or Firm*—Kenway & Jenney

[57] ABSTRACT

In the roll-reefing job sail system disclosed herein, a luff foil, grooved to receive a bead on the luff edge of a jib, is employed to roll up the main portion of a jib sail. The head and tack, however, are not fixedly attached to the luff foil but, rather, are connected to attachment points which are journaled and freely rotatable with respect to the luff foil. Thus, both can freely lag in rotation relative to the central portion of the jib which wraps around the luff foil.

10 Claims, 6 Drawing Figures

ROLL-REEFING JIB SAIL

BACKGROUND OF THE INVENTION

The present invention relates to roll-reefing for jib sails and more particularly to a roll-reefing system which maintains an aerodynamically efficient sail shape for a jib which is partially reefed.

Various roll furling systems have been known heretofore which effectively provide for furling of a jib sail by wrapping thereof around a jib stay or other torsion element. Most such commercially available systems however provide only furling, that is, the sail may be completely wrapped or wound up so as to be effectively stored while out of use. Certain attempts have also been made to provide roll reefing for jib sails, e.g. systems in which the jib may be partially rolled up on a luff element so as to provide a reduced sail area suitable for sailing in heavier winds. These latter attempts, however, have typically met with quite limited success, either due to insufficient torsional rigidity in the jib luff element or due to a wrapping operation which produces a badly distorted sail shape, typically accompanied by extreme tension on the foot and leach tapes.

In accordance with one aspect of the present invention, it has been recognized that the usual poor sail shape and high tension on the leach and foot tapes arises due to the winding of the head and foot of the jib simultaneously with the main portion of the jib luff. The necessarily increased thickness of the taped hems along the leach and foot causes the material in these regions to bunch and draw more rapidly, thereby greatly increasing the tension along these edges. This tension then creates a baggy or full bellied sail. As is understood by those skilled in the art, a full bellied sail is just the opposite of what is desired for increased wind speed. Rather, a flatter sail would be more appropriate.

Prior attempts to remedy or compensate for this problem have typically involved the use of a luff element which is thicker near its middle than toward the ends, the purpose of the thicker central portion being to provide an increased linear rate of wrapping of the belly of the sail, as compared with the head and foot. One example of such a system is that shown in U.S. Pat. No. 3,938,460. Despite being highly complex and necessarily involving luff elements of tapered or graduated sizes, such approaches have also met with very limited success since it has been almost impossible to exactly match the taper of the luff element with the drawing speed required to maintain a desirable sail shape.

Among the several objects of the present invention may be noted the provision of apparatus for roll-reefing a jib sail; the provision of such apparatus which will maintain an efficient and effective jib sail shape over a wide range of settings; the provision of such a system which does not require the use of tapered or graduated luff elements for wrapping the luff of the jib; the provision of such a system which avoids undue tension in the leach and foot of a jib sail being reefed; the provision of such a system which is highly reliable and which is of relatively simple and inexpensive construction. Other objects and features will be in part apparent and in part pointed out hereinafter.

BRIEF DESCRIPTION OF THE INVENTION

Briefly, jib furling apparatus in accordance with the present invention is effective to permit partial reefing of a jib sail. A torsionally stiff luff element is provided which is grooved over a major central portion of its length for receiving the luff bead of a jib. At the bottom of the luff element, means are provided for rotating the element to wrap a jib held thereby. Also at the bottom of the luff element, attaching means are provided to which the tack of a jib may be anchored. Bearings are interposed between the attaching means and the luff element, which bearing means permit the tack of the jib to freely lag in rotation and wrapping relative to the center portion of the jib during furling thereof. Halyard swivel means are provided for attaching the head of a jib to a halyard. The swivel means permits the head of the jib also to freely lag in rotation and wrapping relative to the central portion of the jib being furled. Accordingly, initial rotation of the luff element draws material from the central portion of the jib sail, thereby tending to flatten the sail during reefing and to minimize concentrated loading on the foot and leach.

BRIEF DESCRIPTION OF THE DRAWINGS

Corresponding reference characters indicate corresponding parts throughout the several view of the drawings.

DESCRIPTION OF THE PREFERRED EMBODIMENT

Figure 1:
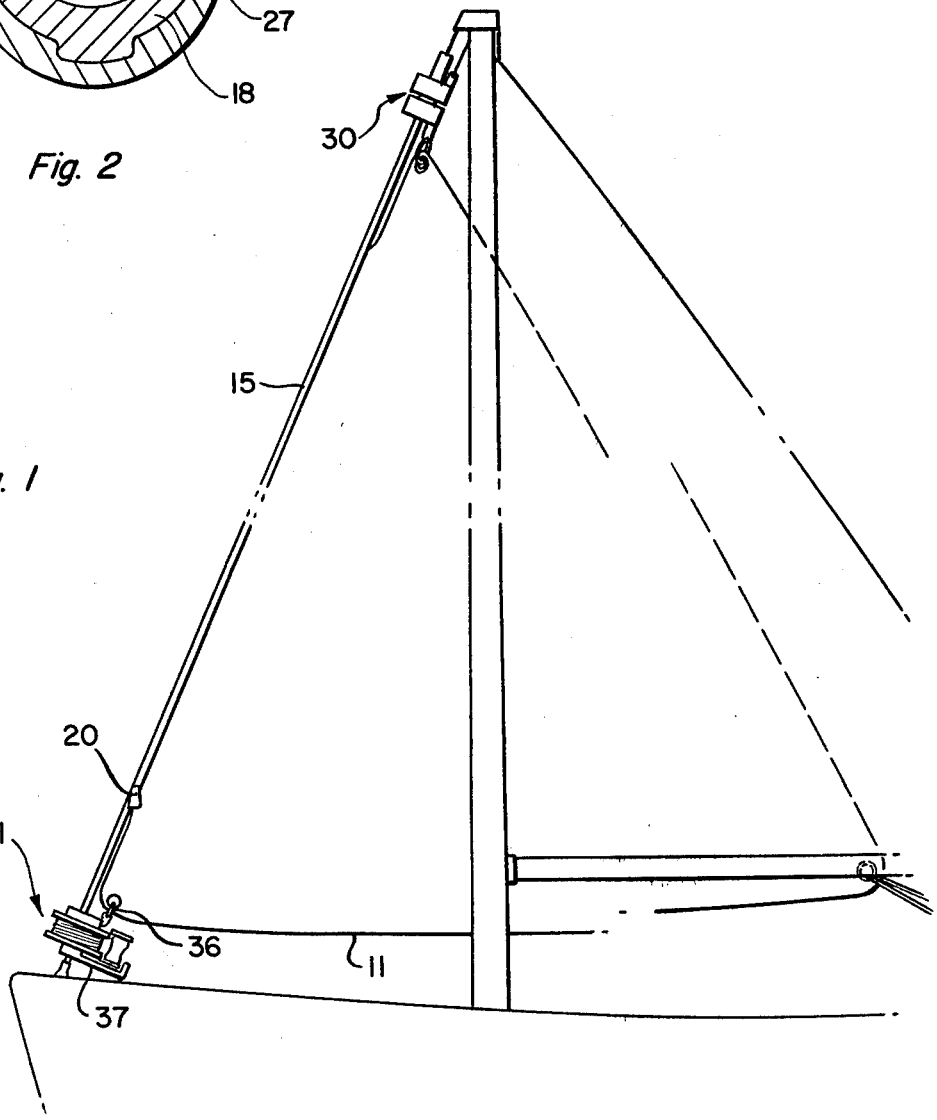
FIG. 1 is a side view of a sailboat provided with jib reefing apparatus in accordance with the present invention.

Referring now to FIG. 1, a jib sail is indicated generally by reference character 11. This sail may, for example, by of the type generally referred to as a Genoa jib, i.e. a relatively large jib providing a substantial overlap with the mainsail in a conventional sloop rigged sailboat. The luff edge of jib 11 is provided, over the major central portion of its length, with a bead designated to cooperate with and fit into a grooved luff foil. Various prior art luff foil systems are disclosed in U.S. Pat. Nos. 3,611,969; 3,938,460; and 3,851,609.

Figure 2:
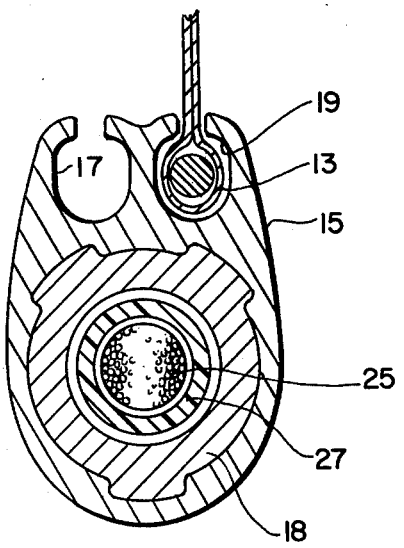
FIG. 2 is a transverse sectional view of a torsionally-stiff grooved luff foil element employed in the embodiment illustrated in FIG. 1.

The particular luff foil employed in the preferred embodiment illustrated is a doubly grooved aluminum extrusion 15 providing two grooves, 17 and 19, either of which can receive the jib luff bead, as indicated at 13 in FIG. 2. The provision of double grooves facilitates the use of the same rigging for racing purposes where it may be desired to frequently change head sails so as to maintain a nearly optimum configuration. Preferably, the luff foil 15 is not itself the head stay or tension element for supporting the mast in the fore and aft direction but, rather, is tubular in cross section and rotates about a conventional wire or rod head stay, such a headstay being indicated at 25 in FIG. 2. Preferably also, a low friction plastic tube 27 is interposed between the stay and the aluminum extrusion so as to minimize friction and wear.

In that the cross section of extrusion 15 comprises a closed tube, each section of the extrusion is torsionally stiff. If it is necessary, e.g. due to shipping considerations, to fabricate the overall luff element in multiple lengths, interfitting coupling sections may be employed, as illustrated at 18 in FIG. 2, to link adjacent sections of the doubly grooved extrusions, while maintaining torsional stiffness.

As may be seen in FIG. 1, only the major central portion of the jib luff is held in the grooved luff element 15. In this regard, an introducing means 20, e.g. a guide similar to that disclosed in U.S. Pat. No. 3,948,200 is placed well above the bottom of the luff element for introducing the luff bead into one of the grooves in the luff foil. Similarly, at the upper end or head of the jib sail 11, the bead 13 is omitted so that the uppermost portion of the jib luff is free from the luff foil extrusion 15. A halyard swivel 30 is interposed between the jib halyard and the head of the jib. At each end, the unattached portion of the luff comprises about five percent of the total luff length, i.e. about two and one half feet in a sail whose overall luff length is about 50 feet.

A drum mechanism 31 is provided at the base of the jib for rotating the luff element. As part of this same assembly, there is provided also a tang 35 to which the tack of the jib may be shackled, as indicated at 36. Tang 35, however, does not rotate with the drum mechanism and the luff element 15 but, rather, is journaled with respect thereto so as to be rotatable independently and essentially freely. The details of construction of this lower end assembly are illustrated in FIG. 3.

Figures 3, 4:
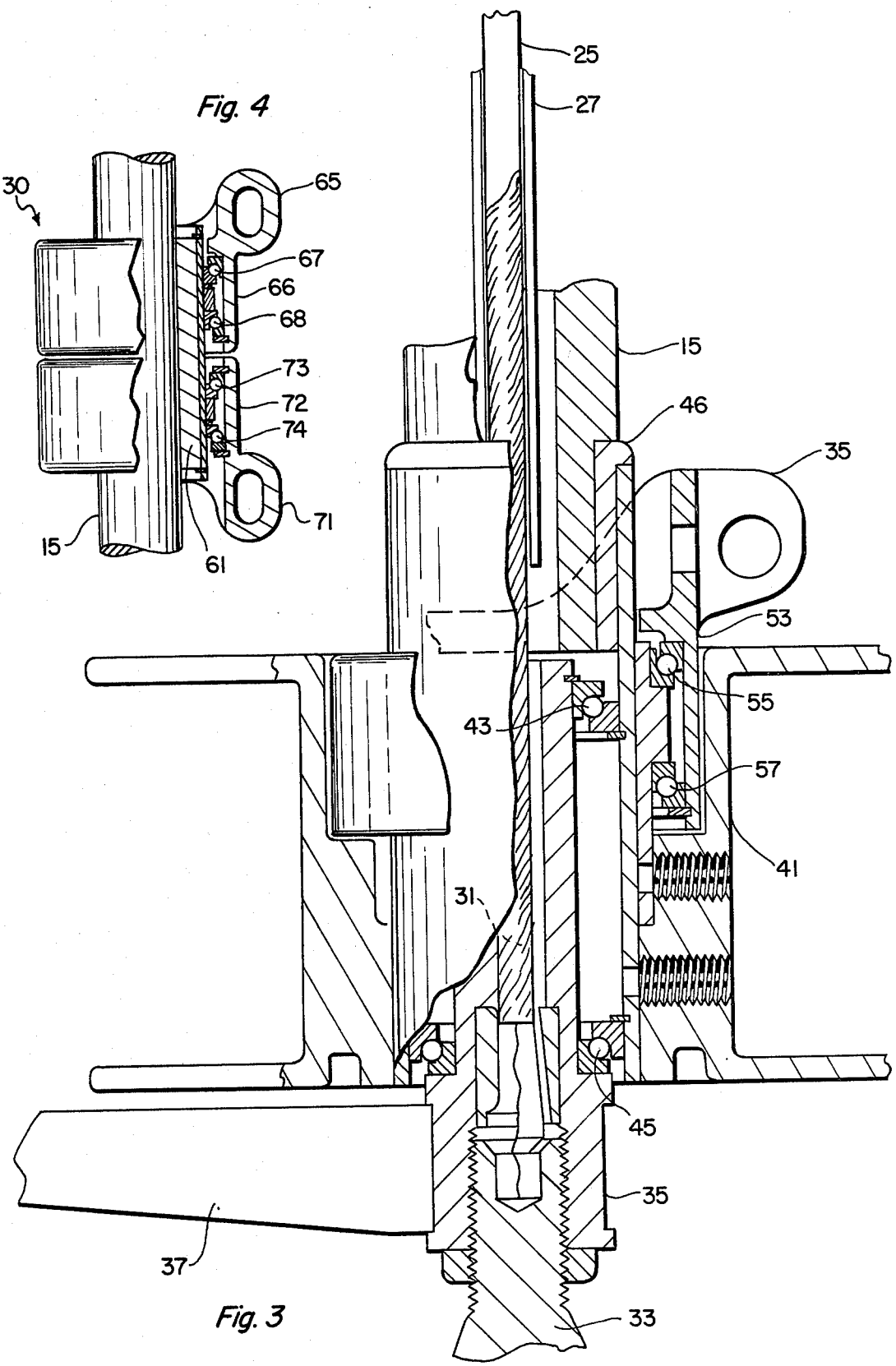
FIG. 3 is a side view, in section, of the bottom portion of the jib furling apparatus of FIG. 1, showing drum means for rotating the luff foil which holds the jib luff.
FIG. 4 is a side view, in section, of a halyard swivel used in the jib furling apparatus of FIG. 1.

Referring now to FIG. 3 the wire headstay itself is indicated by reference character 25. Secured to the bottom of the head stay is an appropriate terminal 33 by means of which the foot of the head stay may be secured to stem fitting of the sailboat. A cylindrical sleeve 35 fits over the upper part of the terminal 33. A guide arm 37 is mounted on this element. A drum 41 is journaled on sleeve 35 by means of a pair of bearings 43 and 45. The luff foil extrusion 15 is mounted on the drum by means of an adapter collar 46. These parts are clamped together so that no relative rotation is permitted. Accordingly, it can be seen that a line wrapped around the drum 41 provides means for rotating the luff foil extrusion 15. Guide arm 37 serves to aid the line in wrapping and unwrapping from the drum.

Tang 35 is formed integrally with a ring or collar 53 which is journaled with respect to the drum 41 by means of bearings 55 and 57 so as to be freely rotatable with respect thereto. Preferably, collar 53 is recessed into the drum 41 so as to minimize the height of this base assembly.

The halyard swivel 30 is illustrated in greater detail in FIG. 4. The halyard swivel comprises a sleeve 61 which is adapted to slide along the luff extrusion 15. Having a corresponding non-circular opening, the sleeve 61 rotates with the extrusion. A halyard tang 65, constructed integrally with a collar 66, is journaled on sleeve 61 by means of bearings 67 and 68. A jib tang 71, constructed integrally with a collar 72, is journaled on sleeve 63 by means of bearings 73 and 74. It can thus be seen that neither the halyard nor the head of the jib are constrained to rotate with the jib foil extrusion when it is rotated to furl the jib 11. For economy construction, it is desirable that the tang assemblies which permit rotation of the jib halyard and jib head be identical, as illustrated, with the assembly, tang 35 and collar 53, which permits relative rotation of the jib foot.

Figure 5:
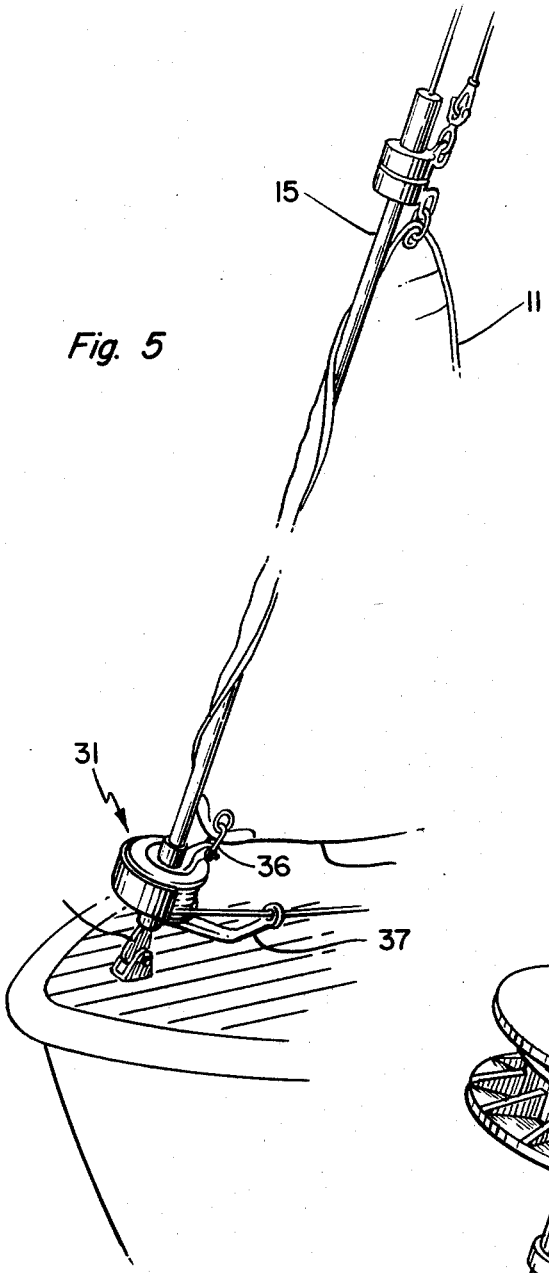
FIG. 5 is a perspective view of the jib furling apparatus of FIG. 1, showing the initial stage of jib reefing.

As described previously, the luff of the jib is not secured to the luff foil extrusion 15 over the entire length of the jib luff, rather about five percent of the luff length is left unattached adjacent the head and foot. Accordingly, when the luff foil extrusion is rotated by means of the drum assembly, material is initially drawn from the belly portion of the jib, and the head and tack of the jib are free to lag behind the major central portion of the luff in wrapping around the luff extrusion. This is illustrated in FIG. 5. Accordingly, the shape of the sail is generally flattened, which is desirable, and tension is let off the leach and foot. This is in contrast to more usual constructions where head and foot rotate with the rest of the luff, tending to cause bunching and thereby creating excessive tension in these seams and causing a bellied shape to the jib sail.

Figure 6:
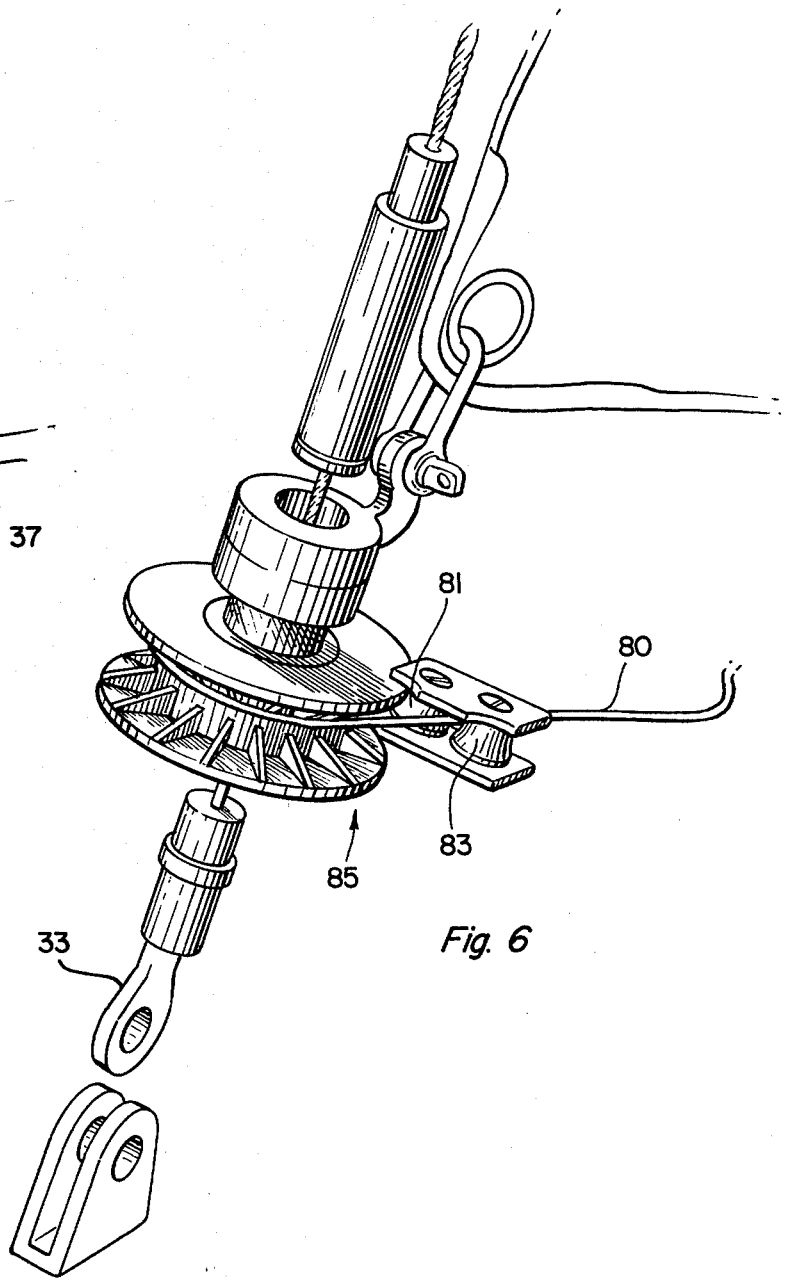
FIG. 6 illustrates an alternative form of driving means for rotating a luff element to effect furling.

An alternative mechanism for rotating the luff foil is illustrated in FIG. 6. Rather than the single line which is wrapped around the drum 41 and then pulled to reef the jib sail, as is done in many conventional systems, the construction illustrated in FIG. 6 employs a continuous loop of line 80 which passes, past rollers 81 and 83 over a sharply grooved and serrated wheel 85 attached to the bottom of the luff foil. Wheel 85 provides enough friction relative to line 80 to prevent slipping. The two runs of the driving line are then led aft, e.g. to the cockpit of the sailboat, where furling can then be remotely controlled by pulling on one of the other of these lines.

While the principal utility of the roll-reefing apparatus of the present invention is in facilitating the reefing of jib sails and the apparatus meets a long felt need in that context, it has also been found that essentially the same apparatus is useful in roll-reefing mainsail systems. For example, in mainsail reefing systems of the type illustrated in U.S. Pat. No. 4,030,439, the luff of the sail is often retained in a grooved element located in a slotted, tubular chamber within the sailboat's main mast. The mainsail is drawn out of the slot in use. As it is desired to provide for variable exposure of the mainsail to suit different wind velocities, somewhat similar, though lesser, problems with respect to sail shape are encountered. By providing swivels or bearing means allowing the head and tack to lag in rotation with respect to the grooved element, these problems are alleviated, just as they are with the jib sail.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. Jib furling apparatus permitting partial reefing of a jib sail, said apparatus comprising:

a torsionally stiff luff element;

a jib sail having the major central portion of the length of its luff continuously attached to said luff element for rotation therewith;

at the bottom of said luff element, means for rotating the element to wrap the jib around the element;

also at the bottom of said luff element, a tack attaching means to which the tack of a jib may be secured;

bearing means interposed between said attaching means and the luff element together with its rotating means, said bearing means permitting the tack of a jib to freely lag in rotation and wrapping relative to the center portion of the jib during furling thereof.

2. Jib furling apparatus permitting partial reefing of a jib sail, said apparatus comprising:

a torsionally stiff luff element grooved over the major central portion of its length for receiving the luff bead of a jib, there being bead introducing means spaced up from the bottom of the element;

at the bottom of said luff element, means for rotating the element to wrap a jib held thereby;

also at the bottom of said luff element, a tack attaching means to which the tack of a jib may be anchored;

bearing means interposed between said attaching means and the luff element together with its rotating means, said bearing means permitting the tack of a jib to freely lag in rotation and wrapping relative to the center portion of the jib during furling thereof; and halyard swivel means for attaching the head of a jib to a halyard, said swivel means permitting the head of a jib to freely lag in rotation and wrapping relative to the central portion of the jib during furling thereof, whereby initial rotation of said element draws material from the central belly of the jib sail tending to flatten the sail and to minimize concentrated loading on the foot and leech.

3. Jib furling apparatus as set forth in claim 2 wherein said halyard swivel means includes; a sleeve which rotates with said luff element; journaled on said sleeve, a tang to which a halyard may be attached; also journaled on said sleeve, a tang to which the jib head may be attached.

4. Jib furling apparatus as set forth in claim 2 wherein about five percent of the jib luff adjacent its head and about five percent of the jib luff adjacent its foot are free of the luff element.

5. Jib furling apparatus as set forth in claim 2 wherein said luff element is a tubular structure which fits over and rotates around a jib stay.

6. Jib furling apparatus as set forth in claim 2 wherein said luff element is a doubly-grooved aluminum extrusion.

7. In a sailboat, jib apparatus for mounting and permitting partial reefing of a jib sail, said apparatus comprising:

a jib stay;

a tubular, torsionally stiff luff element surrounding and rotatable around said stay, said luff element being grooved over the major central portion of its length for receiving the luff bead of a jib;

secured to the bottom of said luff element, drum means for rotating the element to wrap a jib held thereby;

journaled on said drum, also as the bottom of said luff element, a tack attaching means to which the tack of a jib may be anchored, the journaling being operative to permit the tack of a jib mounted on said element to freely lag in rotation and wrapping relative to the center portion of the jib during furling thereof; and halyard swivel means for attaching the head of a jib to a halyard, said swivel means permitting the head of a jib to freely lag in rotation and wrapping relative to the central portion of the jib during furling thereof, whereby initial rotation of said element draws material from the central belly of the jib sail tending to flatten the sail and to minimize concentrated loading on the foot and leech.

8. In a sailboat, jib apparatus for mounting and permitting partial reefing of a jib sail, said apparatus comprising:

a jib stay;

a tubular, torsionally stiff luff element surrounding and rotatable around said stay, said luff element being doubly grooved over at least the major central portion of its length for receiving the luff bead of a jib, there being bead introducing means spaced up from the bottom of the element about five percent of the total luff length;

at the bottom of said luff element, means for rotating the element to wrap a jib held thereby;

also at the bottom of said luff element, a tack attaching means to which the tack of a jib may be anchored;

bearing means interposed between said attaching means and the luff element together with its rotating means, said bearing means permitting the tack of a jib to freely lag in rotation and wrapping relative to the center portion of the jib during furling thereof; and halyard swivel means for attaching the head of a jib to a halyard, being slidable over said luff element and including a sleeve which surrounds said luff element and rotates therewith and a collar carrying a tang to which a halyard may be attached, said collar and tang being journaled for free rotation with respect to said sleeve, said swivel means including also a second collar carrying a tang to which the jib head may be attached, said second collar and tang being also journaled for free rotation with respect to said sleeve, said swivel means thereby permitting the head of a jib to freely lag in rotation and wrapping relative to the central portion of the jib during furling thereof, whereby initial rotation of said element draws material from the central belly of the jib sail tending to flatten the sail and to minimize concentrated loading on the foot and leech.

9. Apparatus for reefing a sail, said apparatus comprising:

a torsionally stiff luff element grooved over at least the major central portion of its length for receiving the luff bead of a sail;

a sail having a luff bead adapted to be held by said grooved luff element, a portion of the luff adjacent the head and a portion adjacent the tack being free of said luff element;

at the bottom of said luff element, means for rotating the element to wrap a sail held thereby;

also at the bottom of said luff element, tack attaching means to which the tack of the sail may be anchored;

bearing means interposed between said attaching means and the luff element together with its rotating means, said bearing means permitting the tack of a sail to freely lag in rotation and wrapping relative to the center portion of the sail during furling thereof; and halyard swivel means for attaching the head of a sail to a halyard, said swivel means permitting the head of the sail to freely lag in rotation and wrapping relative to the central portion of the sail during furling thereof, whereby initial rotation of said element draws material from the central belly of the sail tending to flatten the sail and to minimize concentrated loading on the foot and leech.

10. Jib furling apparatus permitting partial reefing of a jib sail, said apparatus comprising:

a torsionally stiff luff element grooved over the major central portion of its length for receiving the luff bead of a jib, there being bead introducing means spaced up from the bottom of the element;

secured to the bottom of said luff element, a drum for rotating the element to wrap a jib held thereby;

also at the bottom of said luff element, a tang to which the tack of a jib may be anchored;

a ring recessed into and journaled with respect to said drum, said tang being carried by said ring, said journaling including bearing means interposed between said tang and the luff element together with its drum, said bearing means permitting the tack of a jib to freely lag in rotation and wrapping relative to the center portion of the jib during furling thereof; and halyard swivel means for attaching the head of a jib to a halyard, said swivel means permitting the head of a jib to freely lag in rotation and wrapping relative to the central portion of the jib during furling thereof, whereby initial rotation of said element draws material from the central belly of the jib sail tending to flatten the sail and to minimize concentrated loading on the foot and leech.

* * * * *